United States Patent [19]

Seymour et al.

[11] 4,180,874

[45] Jan. 1, 1980

[54] BATHTUB ASSEMBLY

[75] Inventors: Merritt W. Seymour, Sylvania; James E. Jones, Toledo, both of Ohio

[73] Assignee: Owens-Corning Fiberglas Corporation, Toledo, Ohio

[21] Appl. No.: 885,934

[22] Filed: Mar. 13, 1978

Related U.S. Application Data

[63] Continuation of Ser. No. 618,714, Oct. 1, 1975, abandoned.

[51] Int. Cl.[2] ..... A47K 3/00; A47K 3/08

[52] U.S. Cl. ..... 4/173 M; 4/175; 248/149

[58] Field of Search ..... 4/173 R, 173 M, 175, 4/177, 185 R, 186, 162, 148, 191, DIG. 7; 248/23, 149, 151, 646, 649; 52/34, 35

[56] References Cited

U.S. PATENT DOCUMENTS

| | | | |
|---|---|---|---|
| 1,679,838 | 8/1928 | McHugh et al. | 4/173 R |
| 1,955,485 | 4/1934 | Capra | 4/173 M |
| 1,995,045 | 3/1935 | Sundstrom | 4/173 R |
| 2,013,720 | 9/1935 | Thompson | 4/173 R |
| 2,051,398 | 8/1936 | Schmiedencht | 4/173 M |
| 2,242,722 | 5/1941 | Henry | 248/23 |
| 2,609,547 | 9/1952 | Clark | 4/173 M |
| 3,028,603 | 4/1962 | Rodman | 4/173 R |
| 3,479,778 | 11/1969 | Johnson | 4/173 R X |
| 3,588,925 | 6/1971 | Kuypers et al. | 4/173 R |

*Primary Examiner*—Stuart S. Levy

*Attorney, Agent, or Firm*—Ronald C. Hudgens; Greg Dziegielewski

[57] ABSTRACT

A bathtub assembly between two opposed walls of a room where the bathtub assembly contains a bathtub having a support portion. Positioned against each of the opposed walls is a framing assembly where the framing assembly has a support surface. The bathtub is positioned on the framing assembly so that the support portion of the bathtub is in engagement with the support surface of the framing assembly to provide vertical support for the bathtub. A movably mounted securement means is further included in the framing assembly and the securement means is moved into pressed relation against the bathtub to hold the bathtub in position between the opposed walls.

3 Claims, 9 Drawing Figures

BATHTUB ASSEMBLY

This is a continuation, of application Ser. No. 618,714, filed Oct. 1, 1975, now abandoned.

BACKGROUND OF THE INVENTION

The present invention relates to a bathtub assembly that is positioned between two opposed walls of the room. The bathtub used in this assembly has a support portion located at each end of the bathtub. A framing assembly having a support surface in a position against each of the opposed walls of the room. The bathtub is then positioned on the framing assembly so that the support portion of the bathtub rest upon the support surface of the framing assembly. When the bathtub is in position on the framing assembly a movably mounted securement means is used to maintain the bathtub in the proper position.

To date most bathtubs have been installed so that they become a part of the room in which the bathtub is installed. To accomplish this most bathtubs are installed right after the studding or structural members are put in place to form the room. In such an installation the ends of the bathtub normally are against the studding and are securely attached to the studding. The rough plumbing such as the drain and water lines for the bath unit are connected while the bathtub is being positioned against the studding. After the bathtub is put in position and the rough plumbing hooked up, the interior walls in the room are then put in place. The interior walls are usually positioned so that they come down into contact with an upper lip or ledge that extends around the top of the bathtub. A suitable caulking is then used to provide an adequate water seal between the walls and the upper lip of the bathtub. Once the interior walls are in position then the finished plumbing, such as the faucet and drain connections, is completed to provide a complete bath unit.

There are many disadvantages in this type of bathtub installation. Since the bathtub is positioned by having it in contact with the studding in the room the bath unit must be installed after the rough carpentry has been completed on the room. Then after the plumber has installed the bath unit and connected the rough plumbing he must wait until the finished carpenters can come in and construct the interior walls of the room. Then the plumber must return and install the finished plumbing so that a complete bathtub exists. This type of an installation schedule makes it very difficult to coordinate the work that is done by the carpenters and the work that is done by the plumbers. It becomes very expensive if either the plumbers or the carpenters must stand by and wait until the other finishes its work so that they can resume or start the work that falls into their specialty area. Thus, it is very important that the work of the carpenters and the plumbers be all scheduled and coordinated to keep the carpenters and plumbers working in a smooth and efficient manner. If a good schedule is not established it will result in costly wasted or unproductive time for the carpenters and plumbers in addition to delaying the completion of the project. These problems are compounded further when a large number of bath units are being installed in one large building. Under these circumstances there are so many units being installed, it is almost impossible to properly schedule the work. And, as a result the bath units are not installed in an efficient and economical manner.

An additional problem with this type of installation for bathtubs is that the bathtub becomes in effect an integral part of the room in which it is installed. Thus, if the bathtub must be replaced a large portion of the area where the bath unit is located must be removed and then replaced after a new bathtub has been installed. To remove the bathtub a portion of the interior walls that butt up against the bath unit must also be removed. It may also be necessary to remove part of the finished floor that butts up against the front of the bathtub. Then the bathtub must be freed from the support that tie the bathtub into the structural studding. Usually this means that the supports will have to be removed and then probably be replaced before a new bathtub can be installed. Once the old bathtub has been removed and a new bathtub installed then the interior walls of the room that butt up against the bathtub and the finished floor that butts up against the front of the bath unit can be repaired or replaced. This is a very expensive and time consuming replacement process.

An additional problem with this traditional style of bathtub installation is that usually the plumbing from the bathtub is not directly accessible. The plumbing is usually built into one of the end walls of the room in the region where the end of the tub is located so that the wall and the front of the tub block the access to the plumbing. To remedy this situation usually a passageway is cut entirely through the wall so that the plumbing will be excessible from the room that borders the room where the bathtub is located. Usually the passageway in the wall is covered with some type of a removable panel to cover the passageway and the exposed pipes. These panels are not normally very attractive and they cause a decoration problem in the room that is adjacent to the room where the bathtub is located. In addition the access passageway provides, at best, only marginal access to the plumbing. Therefore all maintenance and repair work on the plumbing is usually very difficult to accomplish the access opening.

The installation problems, the maintenance problems and the replacement problems discussed may not seem that significant when only one bathtub is being considered. However, in commercial applications such as hotels and motels, where a number of bathtubs are involved, the difficulties can be a significant problem. Also in commercial applications the use of maintenance and replacement become more important as the fixtures receive more wear and tear and new looking and operating fixtures are a necessity for a successful hotel or motel. Therefore, the bathtubs in these installations will probably receive more maintenance and have a greater chance of being replaced than an ordinary household bathtub. Thus, it is an important step, in at least commercial application, to develop a bathtub assembly that allows for easy repair and replacement of the bathtub assembly.

In recent years some new bath units having side walls as well as a bathtub have come on the market place, and these units have reduced some of the problems and disadvantages previously mentioned. These units usually come either with the sides already attached to the bathtub or with a bathtub and a number of side wall panels that are then attached to the bathtub after the bathtub has been intalled. However, these new units are also attached directly to the studding or framing members of the room. Then the interior walls of the room are put in position so that they butt up against the top and the side walls that are attached to the tub. In addition the plumbing is usually not accessible on these new models and an access passageway must also be used. The method of installation for these units is similar to the method of installation previously described for a traditional style of bathtub although the new units may not require as much time to install. However, the work scheduling problems still exist and the replacement problems previously discussed still exist. Therefore, these new bath units do not offer a complete solution to a problem.

SUMMARY OF THE INVENTION

An object of the invention is an improved bathtub assembly.

Another object of the invention is an improved system for mounting a bathtub in a room.

Yet another object of the invention is a bathtub assembly that is easier to install and remove.

An additional object of the invention is a bathtub assembly that is quicker to install in a room.

Still another object of the invention is a bathtub assembly that provides direct access to the plumbing for the bathtub assembly.

In a broad sense these and other objects of the invention are attained by a bathtub assembly that is positioned between two opposing walls of a room having a bathtub with a support portion. Positioned against each of the opposing walls of the room is a framing assembly that includes a support surface. The support portion of the bathtub is positioned on the support surface of the framing assembly to provide vertical support for the bathtub. To secure the bathtub in position on the framing assembly a movably mounted securement means is moved into pressed relation against the bathtub to hold the bathtub in position between the two opposed walls.

Other objects and advantages of the invention will become apparent as the invention is described hereinafter in more detail with reference made to the accompanying drawings.

DESCRIPTION OF THE PREFERRED EMBODIMENTS

The bath assembly of this invention is particularly useful where it is desired to reduce the time and expense required to install a bath unit. These advantages are particularly important where the bath unit is being installed in a commercial application such as a hotel, apartment or motel where a large number of bath assemblies will be installed at one time. These advantages are accomplished by having a bathtub assembly that can be mounted upon a framing assembly where the framing assembly is positioned between two opposing walls in the room where the bathtub is to be positioned. The bathtub unit is supported and positioned by the framing unit instead of being positioned by the walls and floor of the room. Since the bathtub no longer has to be tied into the walls and floor of the room it is not as difficult to complete the installation of the bathtub assembly.

Figure 1:
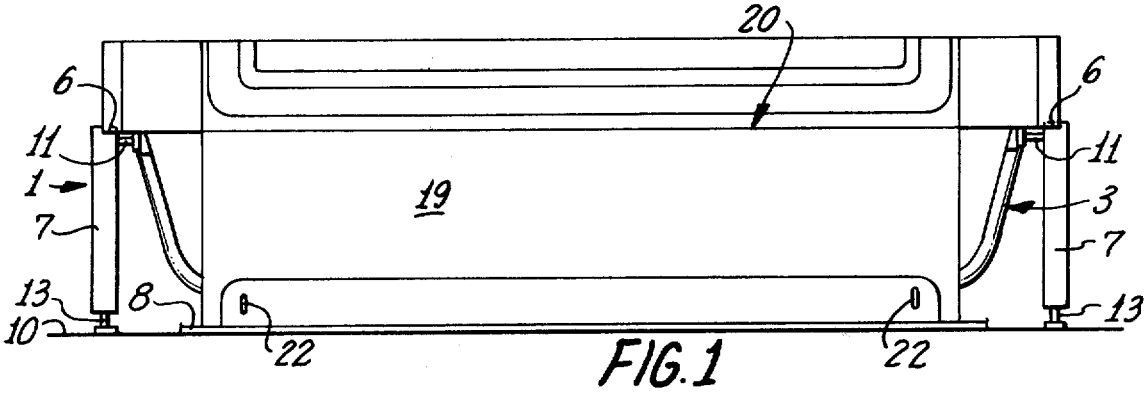
FIG. 1 is a side view of the bathtub assembly.
Figure 2:
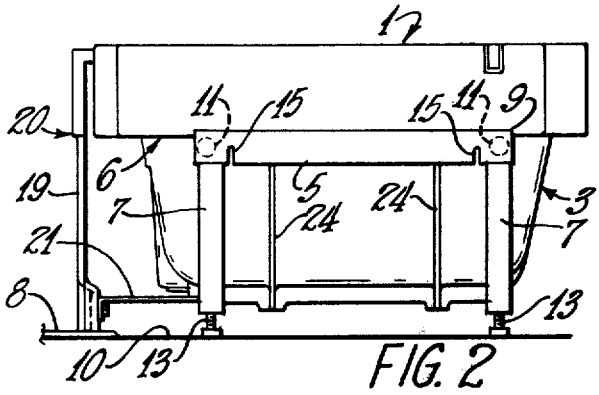
FIG. 2 is an end view of the bathtub assembly.

The features of this invention will be better understood by referring to the detached drawings. FIGS. 1 and 2 show the bath assembly 1 as it is positioned between opposing walls 4 in the room. The opposing walls 4 are normally positioned so that they are spaced apart a distance that is a little bit greater than the length of the bath tub 3. It should be noted that the walls 4 are the finished interior walls of the room, so that the bathtub 3 will fit between the finished opposed walls. The framing assembly is positioned against each of the opposing walls 4 so that the framing assembly can act as the support and positioning means for the bathtub 3. The framing assembly contains a support or leg means 7 and a support surface 5 connected to the leg 7. The support surface 5 of the framing assembly is used to engage the support portion 6 located at each end of the bathtub 3. The support surface 5 provides the vertical support that holds the bathtub 3 in position between the opposed walls 4. The support members or legs 7 keep the support surface 5 at the proper elevation and therefore also keeps the bathtub 3 at the proper elevation. To keep the bathtub 3 from sliding back and forth on the support surface 5 there is a notch 9 constructed in the support portion 6 of the bathtub. The notch 9 is constructed so that it is approximately the same width as the support surface 5. Therefore, the bathtub 3 is positioned on the support surface 5 so that the notch 9, and the support portion 6, fits snuggly over the support surface 5. The notch 9 then fits against the edges of the support surface 5 and keeps the bathtub 3 from sliding back and forth on the support surface 5. There is also the problem of the bathtub 3 moving in a longitudinal direction on the support surface 5 since the bathtub does not extend all the way between the opposing walls 4. In an acceptable bath unit this longitudinal movement of the bathtub 3 must be eliminated. Therefore, a movably mounted securement means or bolt 11 has been positioned on each leg 7 of the framing assembly. The securement means 11 are then moved into pressed relationship against the bathtub. This prevents the bathtub 3 from moving in a longitudinal direction on the support surface 5 and holds the bathtub in position between the opposed walls 4. Thus, the notch 9 and the movably mounted securement means 11 act to locate the bathtub 3 in position between the end walls.

In this bathtub assembly the framing assembly normally supports the bathtub so that the bathtub does not rest upon the floor 10. To accomplish this it is very important that the support portion 6 of the bathtub be strong enough to support the bathtub under normal usage. Since the bathtub does not rest upon the floor 10 it is very important that the bathtub be properly located by the framing assembly so that the bathtub is properly positioned between the opposing walls 4. To aid in positioning the bathtub at the proper location on the leg 7 of the framing assembly have movably mounted based portions 13 that can be moved to vary the length of the leg members. In practice it has been found that a threaded bolt having a foot portion can be used very effectively as the movably mounted based portion of the leg member 7. Thus the base portion 13 of the leg member 7 can be moved to adjust the length of the leg member 7. The variable length of the members 7 allows the support surface 5 of the framing assembly to be positioned at the proper elevation so that it can properly support the bathtub 3. In addition the movably mounted based portions 13 of the legs 7 allow the support surface 5 to be kept in a generally horizontal plane. By keeping the support surface 5 in a generally horizontal plane a generally level surface is provided for the support portion 6, and the bathtub 3 to rest upon. When the support portions 6 of the bathtub is resting on a generally horizontal or level plane the bathtub 3 is being supported in the proper position by the framing assembly.

The framing assembly is normally attached to the opposing walls 4 so that a steady secure surface will be provided for the bathtub to be mounted upon. In addition by securing the framing assembly to the opposing walls this helps to ensure that the framing assembly will not move while the bathtub is being positioned on the framing assembly. To attach the framing assembly to the side walls a slot 15 has been provided in the support surface 5. Usually, a nail, screw or other suitable fastening means is driven through the slot 15, into the walls 4 but it is not intended to provide the support for the framing assembly. Instead the leg members 7 had been provided to give the vertical support required in the framing assembly. The slot 15 has been chosen because it gives some allowance for movement after the framing assembly has been positioned. Thus, if the framing assembly has been improperly aligned when initially secured to the wall 4 the nail or screw in slot 15 can be loosened and the framing assembly repositioned into the proper alignment and then the nail or screw can be redriven into the slot 15 to again secure the framing assembly to the wall. It should be noted that the amount of adjustment that the slot 15 can accommodate is rather small. The slot 15 is only shown as an example of the way that the framing assembly can be secured to the walls and that a number of other methods could be used to secure the framing assembly to the walls. In practice the bathtub 3 will normally be positioned in a room so that the rear of the tub is near or adjacent the rear wall 17 of the room in which the bathtub is located. Therefore, it is very critical that the framing assembly be positioned the proper distance away from the rear wall 17 so that the bathtub 3 will be at the desired location with respect to the rear wall 17 after it has been mounted upon the framing assembly.

Since the bathtub 3 is positioned so that it is mounted off the floor 10 and since the bathtub has a framing assembly upon which it rest at each end the front end of the bathtub must be covered so that the space beneath the bathtub and the framing assembly will be hidden. This can be accomplished by attaching a cover plate 19 to the front of the bathtub 3. The front cover or kick plate 19 extends from the front edge of the tub 20 down to the finished floor 8. The front kick plate 19 is held in position by a bar or member 21 that extends from the kick plate to the bathtub. The member 21 is securely attached to the bottom of the bathtub 3 and once the kick plate is in position against the member 21 and securely fastened thereto the kick plate 19 is securely held in place so that it covers the front surface of the bathtub. In practice it is usually found that a member 21 will be located at each end of the kick plate 19 so that the kick plate will be held more securely in position along the front of the bathtub. In the drawings the kick plate 19 is only shown as covering a portion of the front surface of the bathtub. However, it should be recognized that the kick plate could be larger so that it extends from one opposing wall to the other and therefore would completely cover the front of the bathtub and the framing assembly. However, it is also possible to use a kick plate 19 of the size shown in the attached drawings and add additional cover plates at each end of the bathtub to cover the ends of the bathtub and also the framing assembly. These additional cover panels would be attached to the bathtub in a manner similar to the way that kick plate 19 has been attached to the bathtub. The addition of the kick plate 19 and any additional cover panels that may be necessary to completely cover the front of the bathtub provides a bath unit that is aesthetically pleasing and suitable for installation in almost any type of application.

In practice it has been found that it is best to secure the kick plate 19 and any other additional covering panels on the front of the bathtub to the securement member or bracket 21 by the use of screws or other removable securement means. By removing these removable securement means the kick plate 19 can be removed from the front of the bathtub by merely removing the screws and then removing the kick plate. By using a removable kick plate 19, an access opening is created in the front of the bath unit that can be used to repair or maintain the plumbing that is connected to the bathtub. The access opening is created by removing the front kick plate 19 or any other additional cover panels that happen to be attached to the front of the bathtub. This provides an ideal way to gain direct access to the plumbing connected to the bathtub and should do away with the need for access passageways, through the walls of the room, that are used to gain access to the plumbing for the bathtub. To best utilize the access opening provided by the removable kick plate 19, it is desirable to locate the plumbing for the bathtub near the front of the bathtub as this makes it much easier to gain access to this plumbing. This can best be accomplished by placing the water supply plumbing in one of the front corners of the bathtub. Thus, the faucet that supply water to the bathtub will be located so that the plumbing connected to the faucets will be accessible through the access opening on the front of the bathtub. In addition, the drain for the bathtub and the hardware that goes along with the drain could be located at the front of the bathtub to provide improved access to the plumbing associated with the drain. In practice it has been found that a drain located in the front of the bathtub in position approximately in the center of the length of the bathtub will work very acceptably. This type of drain arrangement provides very good access to the drain plumbing. Although a couple of examples have been given to show possible locations for the plumbing for the bathtub it should be understood that almost any location for the plumbing will be acceptable if it provides access to the plumbing to the access opening on the front of the bathtub.

Figure 4:
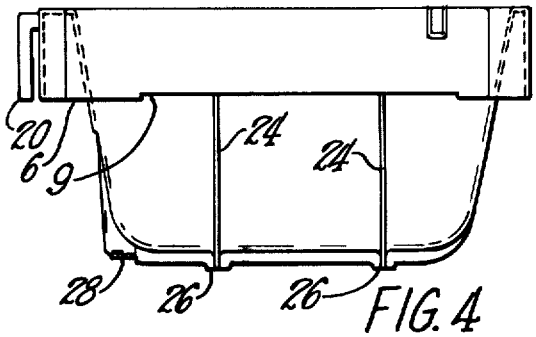
FIG. 4 is an end view of the bathtub that is used in the bath assembly of FIG. 1.
Figure 3:
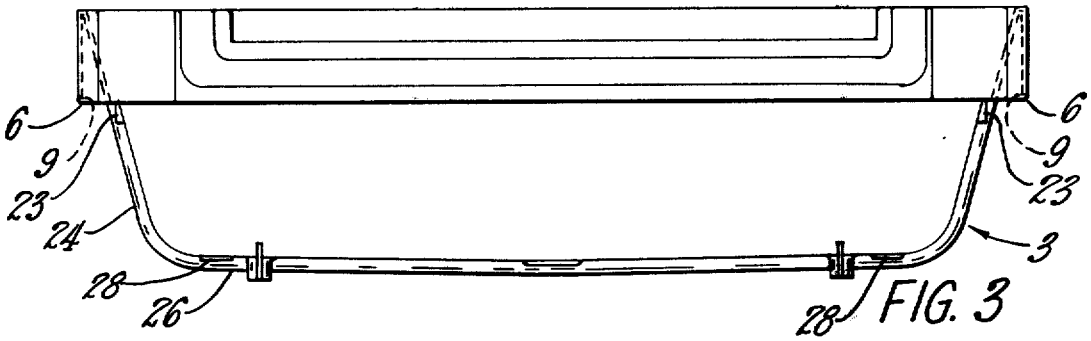
FIG. 3 is a side view of the bathtub that is used in the bath assembly of FIG. 1.

FIGS. 3 and 4 show the bathtub separated from the framing assembly. Here it can be seen how the bathtub is constructed so that it can be mounted upon the framing assembly. The support portion 6 of the bathtub extends across the entire width of the bathtub and provides the surface upon which the bathtub is supported. In the support portion 6 of the bathtub 3 there is a notch 9 located in the support portion, and the surface of the notch 9 is what actually rest upon the framing assembly and therefore it is the portion of the bathtub that receives the vertical support for the rest of the bathtub. Since the bathtub is supported off the floor by the support portion 6 it is very important that this part of the support portion is strong enough to support the bathtub during its intended use. In addition it also very important that the bathtub is strong enough so that it does not flex or bend while it is being used. This problem is again made more critical because the bathtub does not receive any support from the floor. Therefore, supporting ribs 26 have been incorporated into the bottom of the bathtub to provide additional strength and resistance to bending or flexing. Also ribs 24 have been incorporated into the end of the bathtub to add additional strength in this area and this additional strength is required to make the bathtub strong enough so that it can be supported at its ends. Thus, these reinforcing ribs provide the strength that allows the bathtub to be supported at its end when it is mounted between two opposing walls.

Figure 5:
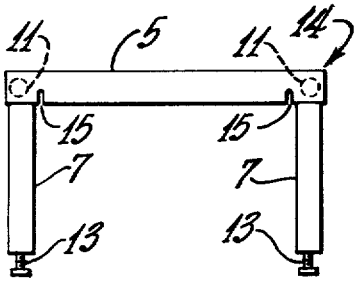
FIG. 5 is a side view of the framing assembly that is used in the bath assembly of FIG. 1.
Figure 6:
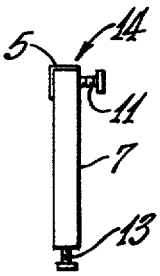
FIG. 6 is an end view of the framing assembly that is used in the bath assembly of FIG. 1.

FIGS. 5 and 6 show the framing assembly 14 in more detail. As can be seen in these figures the framing assembly, that is located at each end of the bathtub, is made up of approximately 3 main pieces. At the top of the framing assembly 14 there is the support surface 5 upon which the support of the bathtub rest. At each end of the support surface 5 there is a support member or leg 7 that provides the vertical support for the support surface 5. In addition to the three main components there are also footed bolts 13 located at the base of each of the leg member 7. The footed bolts 13 can be turned to vary the length of the support leg 7 and thus to vary the vertical elevation at which the support surface 5 is positioned. In addition at the top of each of the leg members 7 there is located another footed bolt 11 that projects from the leg member 7 in a direction that is normal to the plane of the leg member. The footed bolts 11 can be moved so that they come into pressed relation against the surface of the bathtub so that the footed bolts will hold the bathtub in position on the framing assembly 14. The footed bolts 11 can also be used to center the bathtub so that the drain opening and other openings in the bathtub are aligned with the plumbing that is to be connected to these openings. the framing assembly 14 also has slots 15 that are located in the member that comprises the support surface 5. These slots 15 are used to secure the framing assembly 14 to the opposed walls. This can be accomplished by driving a screw or nail through the slot 15 into the opposing wall. When the screw or nail rest tightly against the framing assembly this will act to hold the framing assembly in position of the wall.

In practice it has been found that a framing assembly 14 that is made from glass fiber reinforced plastic materials will work very suitably as a support for a bathtub. This type of reinforced plastic material would allow the main components of the framing assembly to be molded into one piece. Then the footed bolts at the base of the leg and also the footed bolts at the top of the leg members could be put into position on the framing assembly. This would make a very strong and rigid framing assembly that will work very well especially when it is used with a glass fiber reinforced bathtub. In addition to the glass fiber reinforced plastic material, steel, wood or other suitable materials could be used to form the framing assembly as long as they have the required strength and the ability to last as long as the life of the bathtub.

In most normal installations it is usually desirable to have a support surface 5 of the framing assembly in a generally horizontal plane. When the support surface of this level is positioned it provides a very good surface upon which the bathtub can be mounted. Also in most normal installation the support portion of the bathtub must be kept in a generally horizontal plane so that the bathtub is mounted properly. Thus it is important that for the proper results to be achieved that the support surfaces 5 of the framing assembly be in the same horizontal plane to provide an adequate support surface for the bathtub. The footed bolts 13 at the base of each of the leg members 7 provides the means by which the support surface 5 can be kept at the proper horizontal plane. It may be contemplated that in certain applications the support surface 5 of the framing assembly and the support portion 6 of the bathtub should not be in a generally horizontal plane and the framing assembly of this invention could be modified or varied to provide this non-horizontal supporting surface for the bathtub. However, it is believed that in most applications a generally horizontal support surface will provide the best and easiest to install support surface for the bathtub assembly.

Figure 9:
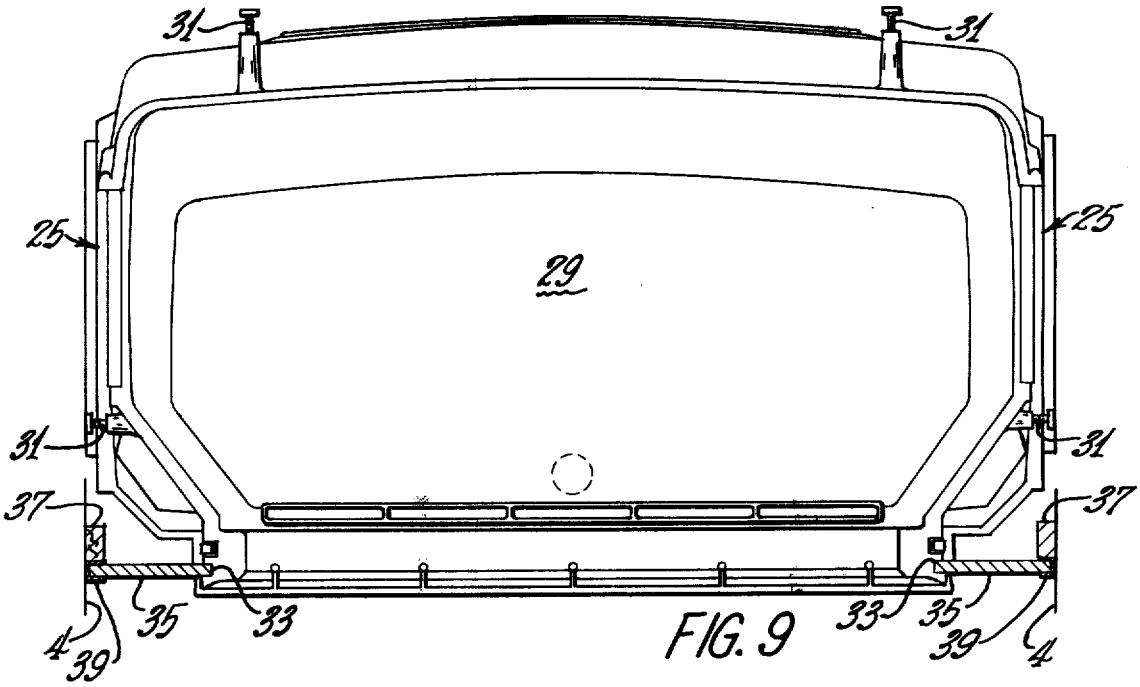
FIG. 9 is a top view of the bath assembly with walls and a top enclosure added to the bath assembly.
Figure 7:
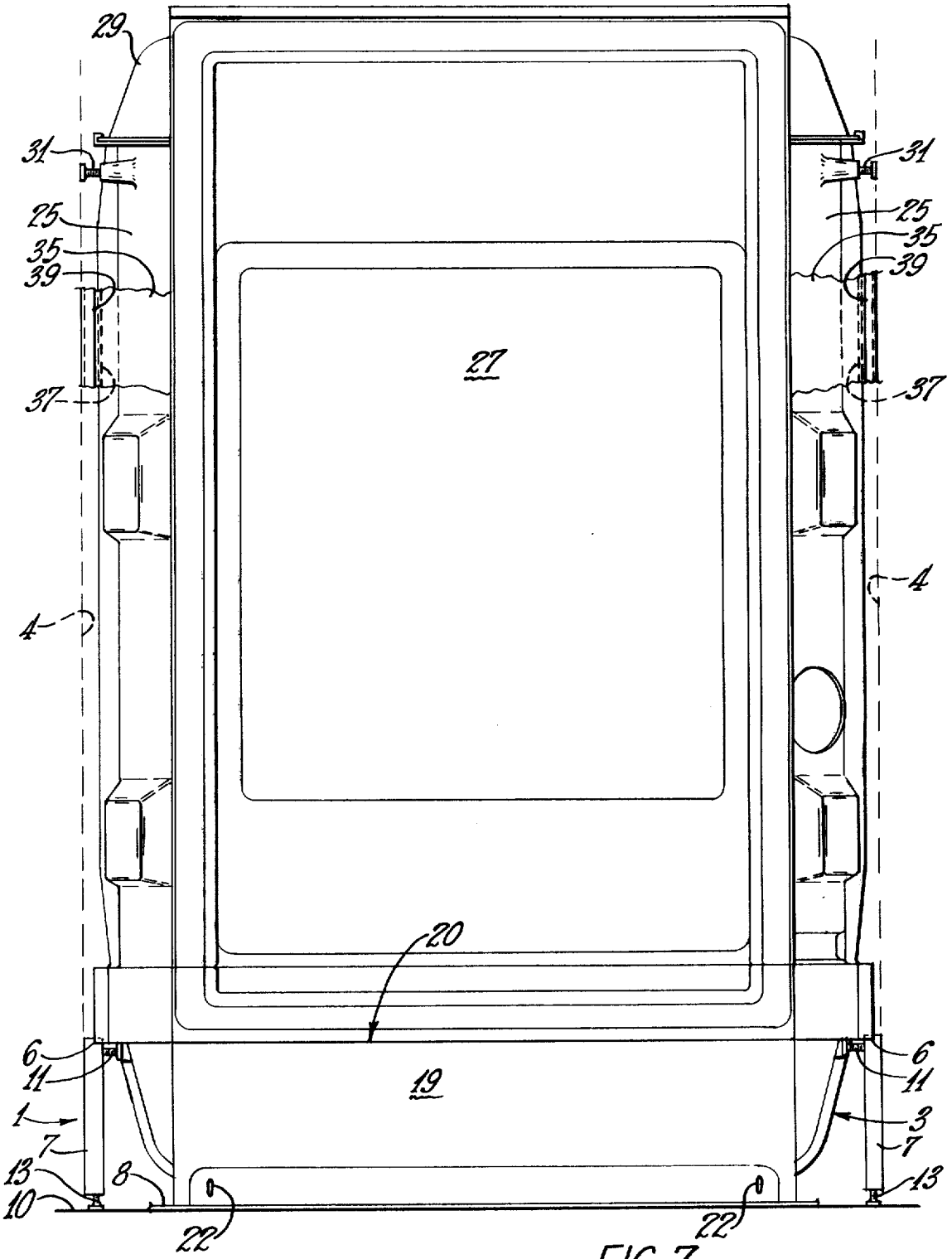
FIG. 7 is a side view of the bath assembly with walls and a top enclosure added to the bath assembly.
Figure 8:
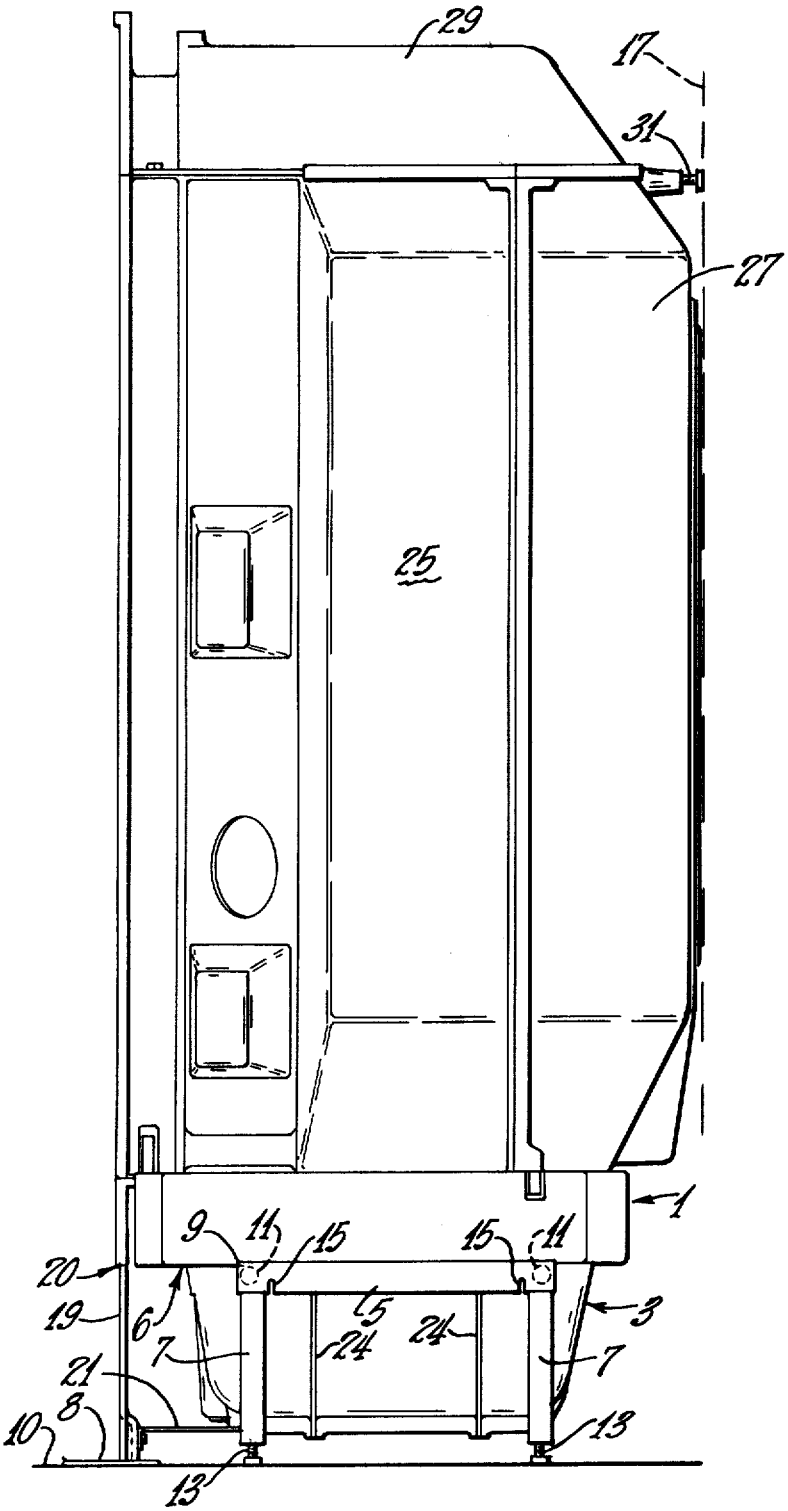
FIG. 8 is an end view of the bath assembly with walls and a top enclosure added to the bath assembly.

FIGS. 7, 8 and 9 show an additional embodiment of the bath assembly. In these figures the bathtub and framing assembly is the same as previously described in the earlier embodiments. However, in these figures two end walls, a back wall and a top enclosure have been added to the bathtub to form a bathing enclosure. The two end walls 25 and the back wall 27 are positioned so that they fit on the upper surface of the bathtub 3. The walls in the bathtub are joined together so that a substantially water tight seal is formed between the walls and the bathtub and between the joints in the walls. Then the top enclosure 29 is positioned on top of the upper surface of the two end walls 25 and the back wall 27. Again the top enclosure 29 forms a substantially water tight seal with the two end walls and the back wall. The back wall 27 is positioned on the bathtub 3 so that the back wall fits in the space that is left between the hub and the rear wall 17 of the room. The two end walls are positioned on the bathtub so that the end walls fit between the opposing walls 4. The walls can be secured to the tub in a number of ways as long as a substantially water tight seal is formed. However, in practice it has been found that metal clips or latches can be used very effectively to secure the walls to the bathtub and also to secure the walls together. It is very important that the walls of the bath assembly to be properly aligned and supported on the bathtub so that a water tight seal will be formed between the walls in the bathtub. To accomplish this footed bolts 31 have been installed in the upper region of the walls so that the bolts may be moved out into pressed relationship against the walls of the room, to ensure that the walls are positioned properly upon the bathtub 3.

As can be seen from the drawings the end panels 25 can very easily have openings provided therein for receiving the faucets and other plumbing for the bathtub. In these, plumbing fixtures can be located near the front end of the bathtub so that they are accessible from the front of the bathtub. Thus very good access can be added to the plumbing for the bath unit when the fixtures are located in the front portion of the side walls 25. With this type of side wall and fixture arrangement it is necessary to provide an access panel 35 that covers the outer edge of the side panel 25 and also the fixtures. The access panel 35 can extend from a groove 33 that is located in the front edge of the side wall 25 and also in the front edge of the top enclosure 29 over to the wall 4 of the room. At the wall the access panel 35 can be mounted in a U shaped channel 39 that is secured to the side wall 4 and also to the stud 37. Thus the access panel extends across the exposed side area of the bath enclosure and completely covers or closes off this area It is important to know that the enclosure 35 can extend all the way from the floor 10 to the top of the top enclosure 29 to completely enclose the side of the bath enclosure. When the access panel 35 is used to cover the entire side region of the bath enclosure it should be designed so that it fits in neatly with the kick plate 19 that is also positioned on the front of the bathtub. Also the access panel 35 can be made from a glass fiber reinforced plastic material. Or the access panel could be made from a dry wall or wall board material that would allow it to be easily matched with the side walls 4 of the room. It is only important that the material for the access panel be sturdy enough to properly cover the side of the bathtub assembly. In addition the U shaped channel 39 can be made from a glass fiber reinforced plastic material, an aluminum extrusion or other suitable material.

From the details of the above described bath assembly it is clear that the bath assembly would be easy to install. Once the finished walls of the room are in place the framing assembly can then be positioned and attached to the two opposing walls. Then the bathtub can be slid into position on the framing assembly on the securement means moved into pressed relationship against the bathtub to hold it in the proper location. Finally the front access panel or panels can be positioned to finish the tub. Next the finished plumbing is connected and the bathtub assembly is ready for use. If the walls and top enclosure are to be used these are simply placed in position prior to installing the access panels. The easy procedure should greatly reduce the amount of time that is normally spent installing the bathtub.

The bathtub assembly is also very easy to remove or replace as the installation procedure is simply reversed to remove the bathtub. The access panels also increase the accessibility of the plumbing for the bathtub and eliminate the need for an access passageway that connects to the room adjoining the room where the bathtub is located. Finally this bathtub assembly reduces the coordination and scheduling problems that can exist between the plumber and carpenters. The plumber installs the rough plumbing in the room and then lets the carpenters install the finished walls of the room. When the finished walls are in place then the plumber can return and install the bathtub assembly and connect the finished plumbing. Thus, the number of occasions when the work of the carpenters and plumbers must interface has been reduced and this should simplify the construction of the bathroom.

Having described the invention in detail and with reference to particular materials, it should be understood that such specifications are given for the sake of explanation. Various modifications and substitutes other than those cited may be made without departing from the scope of the invention as described by the following claims.

We claim:

1. A bathtub assembly adapted to be positioned between two opposed sidewalls and a third wall between said sidewalls of a room comprising:

a bathtub having a support section having a notch therein at each end of said bathtub and at least one pad formed at each end of said bathtub adapted to receive an after-defined first horizontally adjustable securement means positioned below said notches;

a pair of framing members adapted to be individually secured to one of said opposed walls of the room, each of said framing members having a support surface adapted to engage one of said notches in said support section, each of said framing members having a pair of legs containing a vertically adjustable support means at the foot of each leg, each leg further having first horizontally adjustable securement means at the end of each leg opposite the foot to contact said pad;

a first end wall adapted to contact said tub at one end and extending upwardly therefrom and having a second horizontally adjustable securement means located at the end of the first end wall opposite the end adapted to contact said bathtub, said second horizontally adjustable securement means being adapted to contact one of the opposed walls of the room;

a second end wall adapted to contact said tub at one end and extending upwardly therefrom and having a third horizontally adjustable securement means located at the end of the second end wall opposite the end adapted to contact said bathtub, said third horizontally adjustable securement means being adapted to contact the other opposed wall of the room;

a top enclosure adapted to engage said first and second end walls to maintain a predetermined spacing between said first and second end walls as said horizontally adjustable securement means of said end walls are urged against the respective opposed walls of the room; and means for securing said first and second end walls to said bathtub.

2. The apparatus of claim 1 further comprising a sidewall having a fourth horizontally adjustable securement means positioned at the end of said sidewall opposite the end adapted to contact said bathtub, the fourth horizontally adjustable securement means being adapted to contact said third wall of the room.

3. The apparatus of claim 2 wherein said adjustable securement means and adjustable support means are threaded assemblies.

* * * * *